US007611136B2

(12) United States Patent
Marcinik et al.

(10) Patent No.: US 7,611,136 B2
(45) Date of Patent: Nov. 3, 2009

(54) DOCUMENT STREAM MERGING METHOD AND APPARATUS

(75) Inventors: Robert F. Marcinik, Wallkill, NY (US); Edward M. Ifkovits, New Fairfield, CT (US); Peter K. Zanger, Naugatuck, CT (US)

(73) Assignee: Pitney Bowes Inc., Stamford, CT (US)

( * ) Notice: Subject to any disclaimer, the term of this patent is extended or adjusted under 35 U.S.C. 154(b) by 257 days.

(21) Appl. No.: 11/800,359

(22) Filed: May 4, 2007

(65) Prior Publication Data

US 2008/0272533 A1 Nov. 6, 2008

(51) Int. Cl.
*B65H 5/22* (2006.01)

(52) U.S. Cl. ..... 271/3.03; 271/3.14; 271/9.01; 271/9.11; 271/9.13; 270/58.01; 270/58.29; 270/52.16

(58) Field of Classification Search ..... 271/3.01, 271/3.03, 3.14, 9.01, 9.11, 9.13; 270/58.01, 270/58.29, 52.16
See application file for complete search history.

(56) References Cited

U.S. PATENT DOCUMENTS 3,595,561 A * 7/1971 Leblant ..... 271/9.01
3,815,897 A * 6/1974 Hoehl et al. ..... 271/9.13
4,354,671 A * 10/1982 Bergland ..... 270/58.01
4,684,118 A * 8/1987 Boss et al. ..... 271/288
5,083,769 A 1/1992 Young, Jr.
6,460,844 B1 * 10/2002 Clifford et al. ..... 271/9.13
6,644,657 B2 * 11/2003 Wright et al. ..... 271/242
7,121,544 B2 10/2006 Masotta et al.
2007/0013119 A1 * 1/2007 Masotta et al. ..... 271/3.01

* cited by examiner

*Primary Examiner*—David H Bollinger
(74) *Attorney, Agent, or Firm*—Christopher H. Kirkman; Angelo N. Chaclas

(57) ABSTRACT

A collation control mechanism is used to transfer a collation from a dual accumulator to an exit nip of a collation machine. The collation control mechanism has a middle drum and two side rollers to form an upper nip and a lower nip. The drum is caused to rotate alternately in a clockwise direction and in a counter-clockwise direction for transferring a collation from the upper bay and the lower bay, respectively, to the exit nip. A motor is used to drive the drum in both the clockwise and counter-clockwise direction. A coupling mechanism including two sets of one-way clutches is used to engage the motor to the upper and lower rollers of the exit nip so that the upper roller is caused to rotate only in the counter-clockwise direction while the lower roller is cause to rotate only in the clockwise direction.

9 Claims, 10 Drawing Sheets

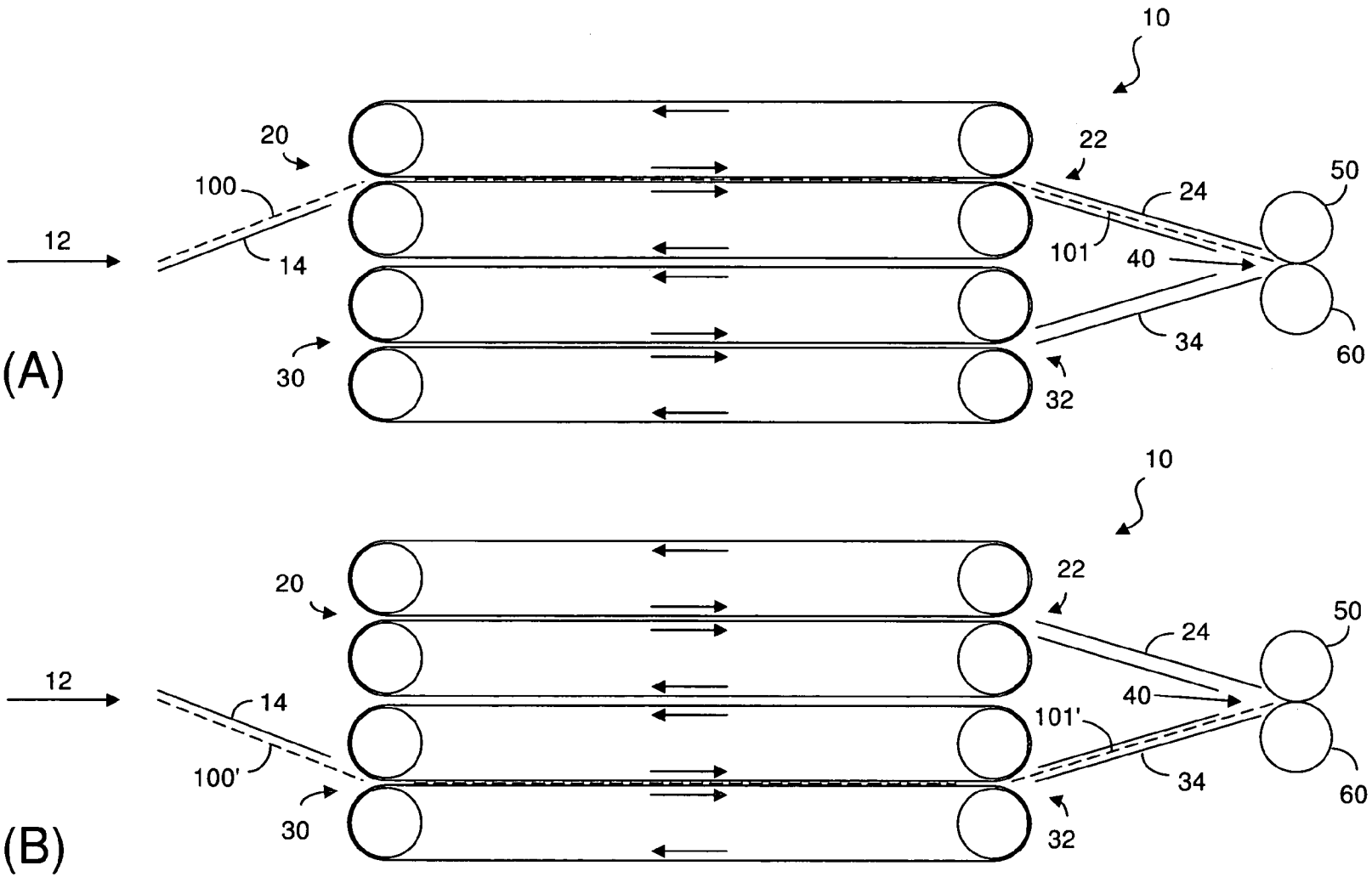
FIG. 1 (priort art)

DOCUMENT STREAM MERGING METHOD AND APPARATUS

FIELD OF THE INVENTION

The present invention relates generally to a collating machine and, more particularly, to a dual accumulator in the collating machine for collating serially fed sheets of document into stacks.

BACKGROUND OF THE INVENTION

Collating machines are frequently used in line with other paper handling equipment as a means for assembling a plurality of sheets of document into a stack. The stack is transferred to a folding stage for folding, if necessary, and then to an insertion stage where the stack is inserted in an envelope. Some collating machines have a dual accumulator which uses two accumulator bays from which completed accumulations are discharged back into a single transport path.

FIGS. 1A and 1B illustrate a prior art dual accumulator. As shown, the dual accumulator 10 has an upper bay 20 and a lower bay 30. A paper path 12 is split into two paths by a deflector 14 so that input sheets can be accumulated in two bays alternately. As shown in FIG. 1A, the deflector 14 is positioned such that a sheet of document transported along the paper path 12 is directed to the upper bay along a paper path 100. After the collation is completed, the collation is released from the upper bay end 22 through a guide 24 along a release path 101. As shown in FIG. 1B, the deflector 14 is positioned such that a sheet of document transported along the paper path 12 is directed to the lower bay along the paper path 100'. After the collation is completed, the collation is released from the lower bay end 32 through a guide 34 along a release path 101'. The collations are alternately released from the upper bay end 22 and the lower bay end 32 back to a single paper path through an exit nip 40. The exit nip 40 is formed by an upper roller 50 and a lower roller 60.

FIG. 2A shows the paper path 101 between the upper bay end 22 and the exit nip 40, and FIG. 2B show the paper path 101' between the lower bay end 32 and the exit nip 40 in the merging region of the accumulator. In the conventional design, accumulations of short sheets present a problem if the length of the sheets is smaller than the path 101 or 101'. Because once the short accumulations are released from the bay ends, they are temporarily not under the position control of any roller nips. Without such positive control, accumulations would skew or come out of alignment. In some instances, the accumulations might even come to a stop between the roller nips. Thus lack of positive control may cause problems by causing a jam, or by causing other problems in the downstream folding or insertion stages.

Thus, it is advantageous and desirable to provide a method and apparatus for keeping each of the released collations, whether it is released from the upper bay or the lower bay, under a positive control when the collation is in the merging region.

SUMMARY OF THE INVENTION

The present invention uses a collation control mechanism located in the merging region of a dual accumulator to provide positive control of the collations released from the upper and lower bays. The apparatus has a drum rotatable in a clockwise direction to transfer a collation from the upper bay to the exit nip, and in a counter clockwise direction to transfer a collation from the lower bay to the exit nip.

Accordingly, the first aspect of the present invention is a method for use in a dual accumulator having a first bay end and a second bay end. The method comprises:

providing a rotatable drum between an exit nip and the dual accumulator;

causing the rotatable drum to rotate in a clockwise direction for transferring a collation from the first bay end to the exit nip, or to rotate in a counter-clockwise direction for transferring a collation from the second bay end to the exit nip;

engaging a first roller with the rotatable drum for causing the first roller to rotate in the counter-clockwise direction when the rotatable drum rotates in the clockwise direction for forming a first nip for transferring the collation from the first bay end; and engaging a second roller with the rotatable drum for causing the second roller to rotate in the clockwise direction when the rotatable drum rotates in the counter-clockwise direction for forming a second nip for transferring the collation from the second bay end.

If one driving mechanism is used to drive both the collation control mechanism and the exit nip formed by a first exit roller and a second exit roller, it is possible to mechanically couple one or both of the exit rollers with the rotatable drum, directly or indirectly, such that the second exit roller is caused to rotate in the clockwise direction when the rotatable drum rotates in the clockwise or the counter-clockwise direction.

The second aspect of the present invention is an apparatus for control of the collations in the merging region between a dual accumulator and an exit nip of a collation machine. The apparatus comprises:

a rotatable drum positioned between the exit nip and the dual accumulator, the rotatable drum is adapted to rotate in a clockwise direction for transferring a collation from a first bay of the dual accumulator to the exit nip, or in a counter-clockwise direction for transferring a collation from a different second bay of the dual accumulator to the exit nip;

a first roller, located adjacent to the rotatable drum, for forming a first nip with the rotatable drum, wherein when the rotatable drum rotates in the clockwise direction, the first roller is caused to rotate in the counter-clockwise direction for transferring the collation from the first bay through the first nip; and a second roller, located adjacent to the rotatable drum and spaced from the first roller, for forming a second nip with the rotatable drum, wherein when the rotatable drum rotates in the counter-clockwise direction, the second roller is caused to rotate in the clockwise direction for transferring the collation from the second bay through the second nip.

The rotatable drum can be directly or indirectly linked to a driving mechanism so that the rotatable drum is caused to rotate in the clockwise or counter-clockwise direction.

According to one embodiment of the present invention:

the first roller is fixedly attached to a first roller shaft for rotation, the second roller is fixedly attached to a second roller shaft for rotation, and the rotatable drum is fixedly attached to a drum shaft for rotation, wherein the first roller shaft comprises a first roller gear fixedly attached to the first roller shaft, the second roller shaft comprises a second roller gear fixedly attached to the second roller shaft; and the drum shaft comprises a drum shaft gear fixedly attached to the drum shaft, the drum shaft gear separately engaged with the first roller gear and the second roller gear. The apparatus further comprises:

a driving mechanism, operatively engaged with one of the first roller shaft, the second roller shaft and the drum shaft for driving the first roller shaft, the second roller shaft and the drum shaft.

According to the present invention, the exit nip has a first exit roller and a second exit roller, wherein the first exit roller and the first exit roller are adapted to rotate in opposite directions, and a coupling mechanism is used for engaging at least one of the first and second rollers to the driving mechanism for rotation.

According to one embodiment of the present invention:

the driving mechanism is engaged with the second roller shaft for driving the first roller shaft, the second roller shaft and the drum shaft, the first exit roller is adapted to rotate in the counter-clockwise direction, and the second exit roller is adapted to rotate in the clockwise direction, wherein the coupling mechanism comprises:

a first set of one-way clutches for mechanically engaging the second exit roller to the second shaft for causing the second exit roller to rotate in the clockwise direction, and a second set of one-way clutches for mechanically engaging the second exit roller to the second shaft through a transfer axis for causing the second exit roller to rotate in the clockwise direction.

According to another embodiment of the present invention:

the coupling mechanism comprises:

a first set of one-way clutches for mechanically engaging the first exit roller to the second shaft for causing the first exit roller to rotate in the counter clockwise direction, and a second set of one-way clutches for mechanically engaging the second exit roller to the second shaft for causing the second exit roller to rotate in the clockwise direction.

According to the present invention, the first exit roller and the second exit roller can be engaged with the second draft through a transfer axis.

The third aspect of the present invention is a sheet collator. The sheet collator comprises:

an exit nip; and a dual accumulator, wherein the dual accumulator comprising a first bay for collating sheets received in the first bay into a collation, the first bay having a first bay end for releasing the collation to the exit nip, and a second bay, located adjacent to the first bay, for collating sheets received in the second bay into a collation, the second bay having a second bay end for releasing the collation to the exit nip;

a rotatable drum positioned between the exit nip and the dual accumulator; wherein the rotatable drum is adapted for rotating in a clockwise direction for transferring the collation from the first bay end to the exit nip, or in a counter-clockwise direction for transferring a collation from the second bay end to the exit nip;

a first roller, located adjacent to the rotatable drum, for forming a first nip with the rotatable drum, wherein when the rotatable drum rotates in the clockwise direction, the first roller is caused to rotate in the counter-clockwise direction for transferring the collation from the first bay through the first nip; and a second roller, located adjacent to the rotatable drum and spaced from the first roller, for forming a second nip with the rotatable drum, wherein when the rotatable drum rotates in the counter-clockwise direction, the second roller is caused to rotate in the clockwise direction for transferring the collation from the second bay through the second nip.

The present invention will become apparent upon reading the description taken in conjunction with FIGS. 3A to 6.

BRIEF DESCRIPTION OF THE DRAWINGS

FIGS. 1A and 1B are schematic representations of a prior art dual-accumulator having an upper bay and a lower bay for simultaneous collation, wherein FIG. 1A illustrates a situation when the paper path is diverted to the upper bay and FIG. 1B illustrates a situation when the paper path is diverted to the lower bay.

FIGS. 3A and 3B show a collation control mechanism disposed between the bay ends and the exit nip in a dual-accumulator, according to the present invention, wherein FIG. 3A illustrates the collation release path through the upper nip of the control mechanism, and FIG. 3B illustrates the collation release path through the lower nip of the control mechanism, according to the present invention.

DETAILED DESCRIPTION OF THE INVENTION

The present invention provides a method and a mechanism for positive control of the collations released from the upper or the lower bay end to a merging region of a dual-accumulator. Because of the short and narrow space in the merging region between the bay ends and the exit nip, adding two more sets of roller nips is impractical or even infeasible. In particular, it would be very difficult to fit the drives and bearings for driving the two more sets of roller nips in the merging region.

Figure 2A:
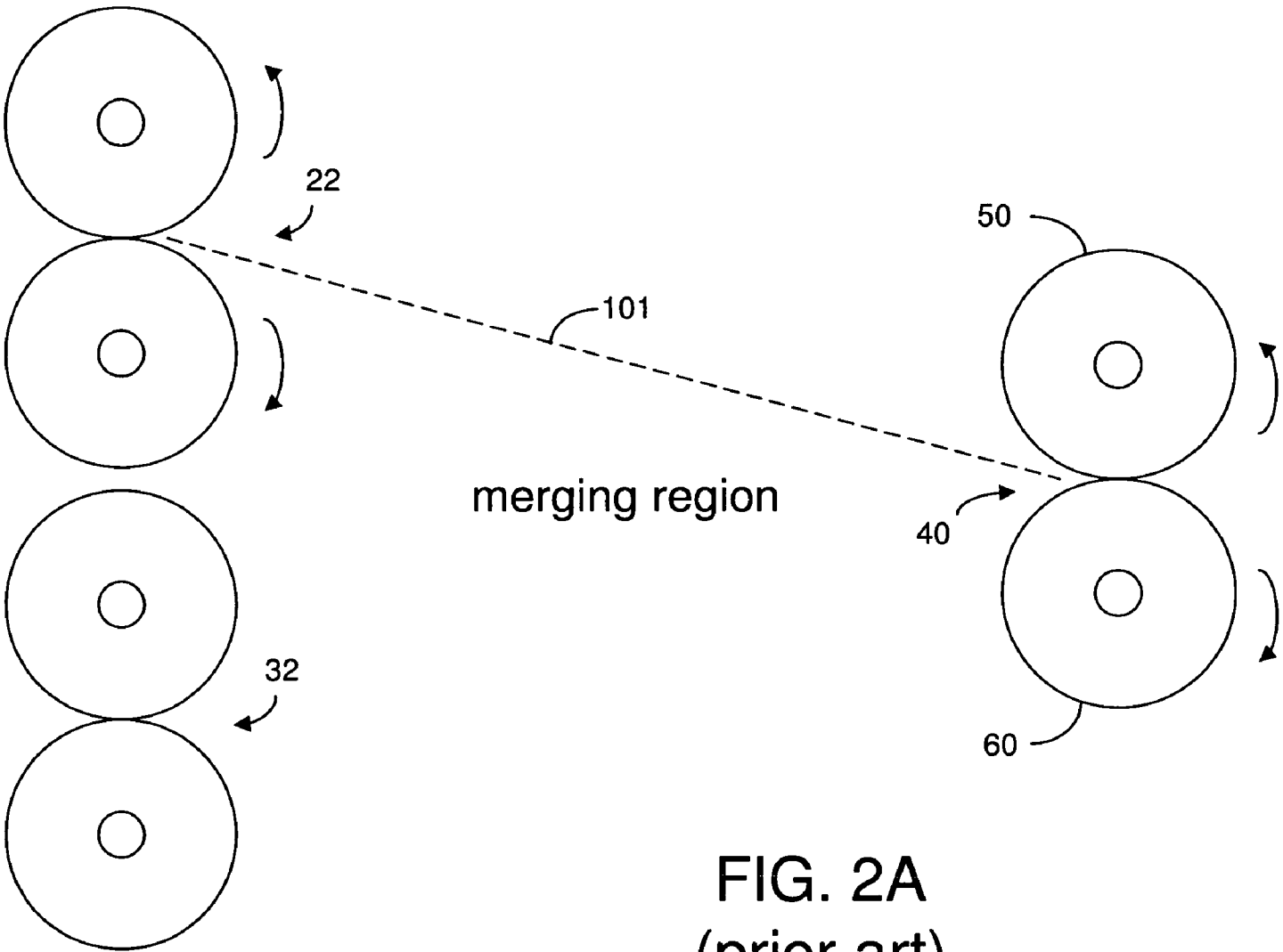
FIG. 2A (prior art)
FIG. 2A illustrates the collation release path between the upper bay end and the exit nip in a prior art dual-accumulator.
Figure 2B:
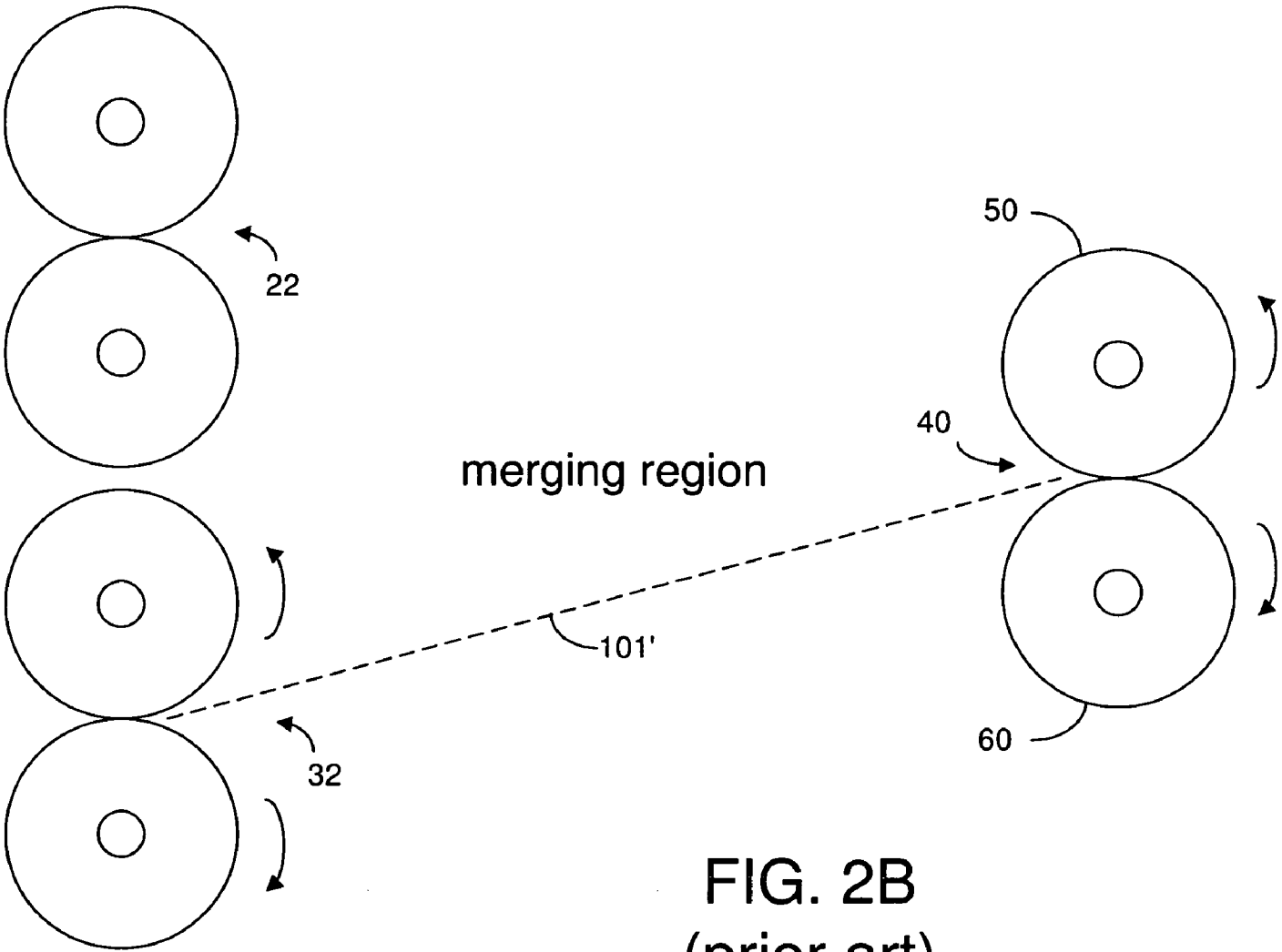
FIG. 2B (prior art)
FIG. 2B illustrates the collation release path between the lower bay end and the exit nip in a prior art dual-accumulator.
Figure 3A:
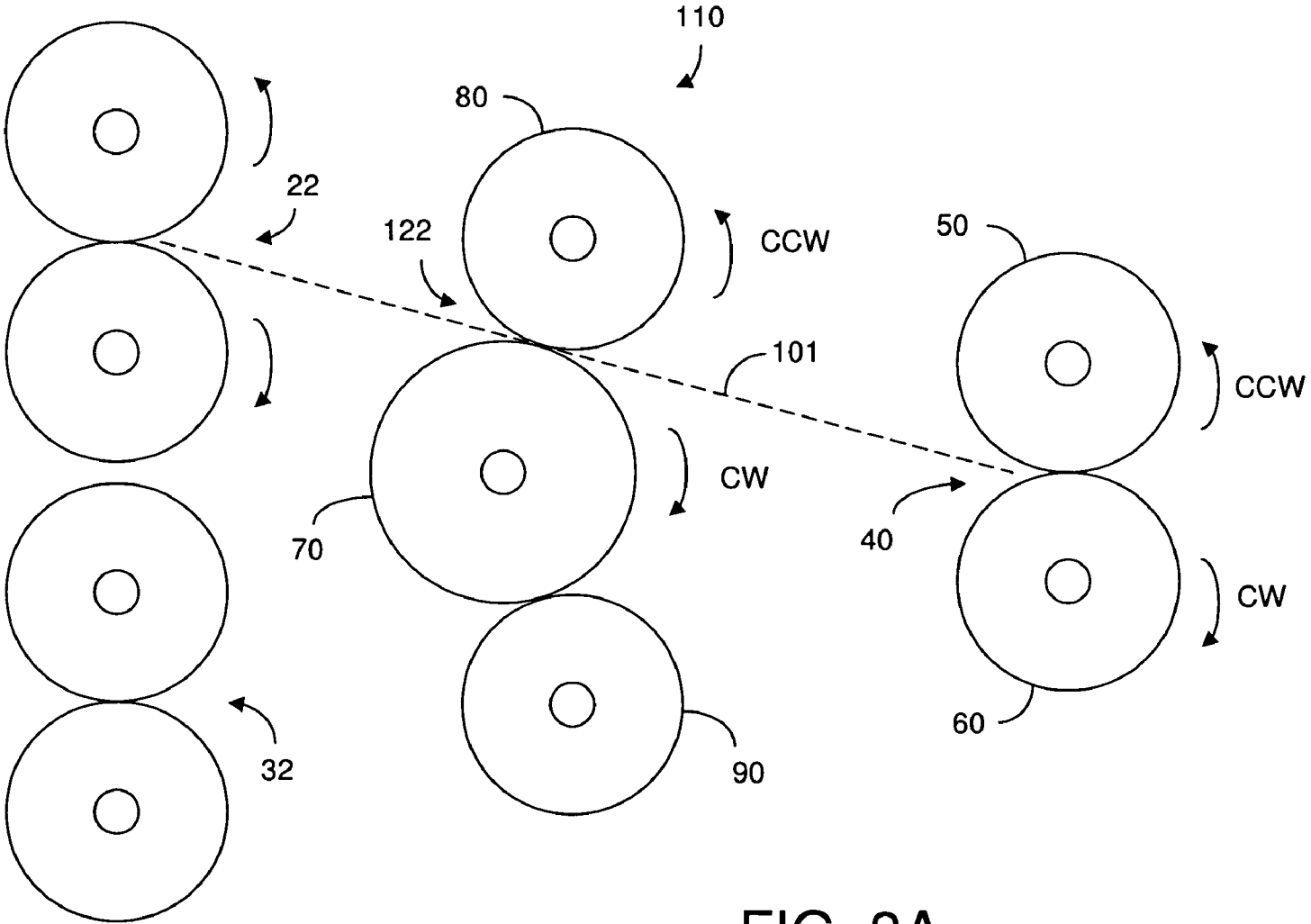
Figure 3B:
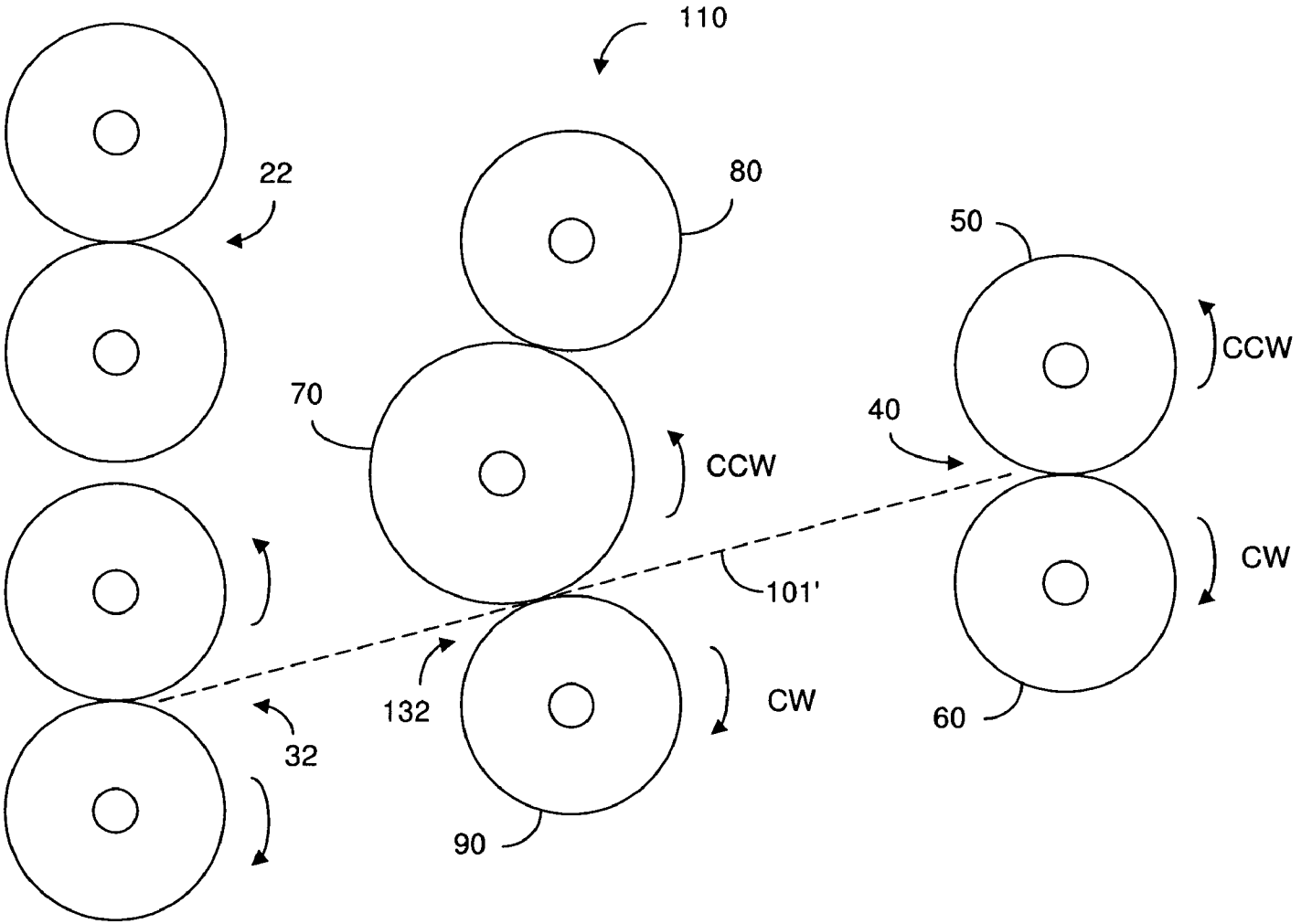

The present invention uses a single drum or roller to form two nips with two pulleys. A schematic representation of a collation control mechanism, according to the present invention, is shown in FIGS. 3A and 3B. As shown in FIG. 3A, the control mechanism 110 has a drum 70 and two rollers or pulleys 80 and 90. The drum 70 and the upper roller 80 form an upper nip 122. The upper nip 122 effectively divides the collation release path 101 into two sections, with each section being shorter than the length of anticipated shortest sheets to be collated. For example, if the shortest sheets are 4 inches in length and the path 101 is about 6 inches in total, a skew may occur to a released collation when there is no positive control of the collation in the merging region. If the path 101 is divided into two equal sections, the 4-inch sheets will be under positive control at all times while they are in the merging region. By adjusting the diameter of the drum 70, the path 101 can be divided differently. For example, by enlarging the drum diameter, the path 101 can be divided into a 2.8 inch section and a 3.2 inch section, for example, with the longer section adjacent to exit nip 40. Likewise, the path 101' is divided by the lower nip 132 formed by the drum 70 and the lower roller 90, as shown in FIG. 3B.

It should be noted that, when the upper nip 122 is used to transport a collation from the upper bay end 22 to the exit nip 40, the drum rotates in a clockwise direction and the upper roller 80 rotates in a counter-clockwise direction, as shown in FIG. 3A. When the lower nip 132 is used to transport a collation from the lower bay end 32 to the exit nip 40, the drum 70 rotates in a counter-clockwise direction and the lower roller 90 rotates in a clockwise direction, as shown in FIG. 3B. Thus, the drum 70 must be driven by a driving mechanism in an oscillatory fashion. For example, the drum 70 can be driven by a servo-motor or a stepper motor so that it can rotate alternately in the clockwise direction and the counter-clockwise direction, independently of the exit rollers 50 and 60.

Figure 4:
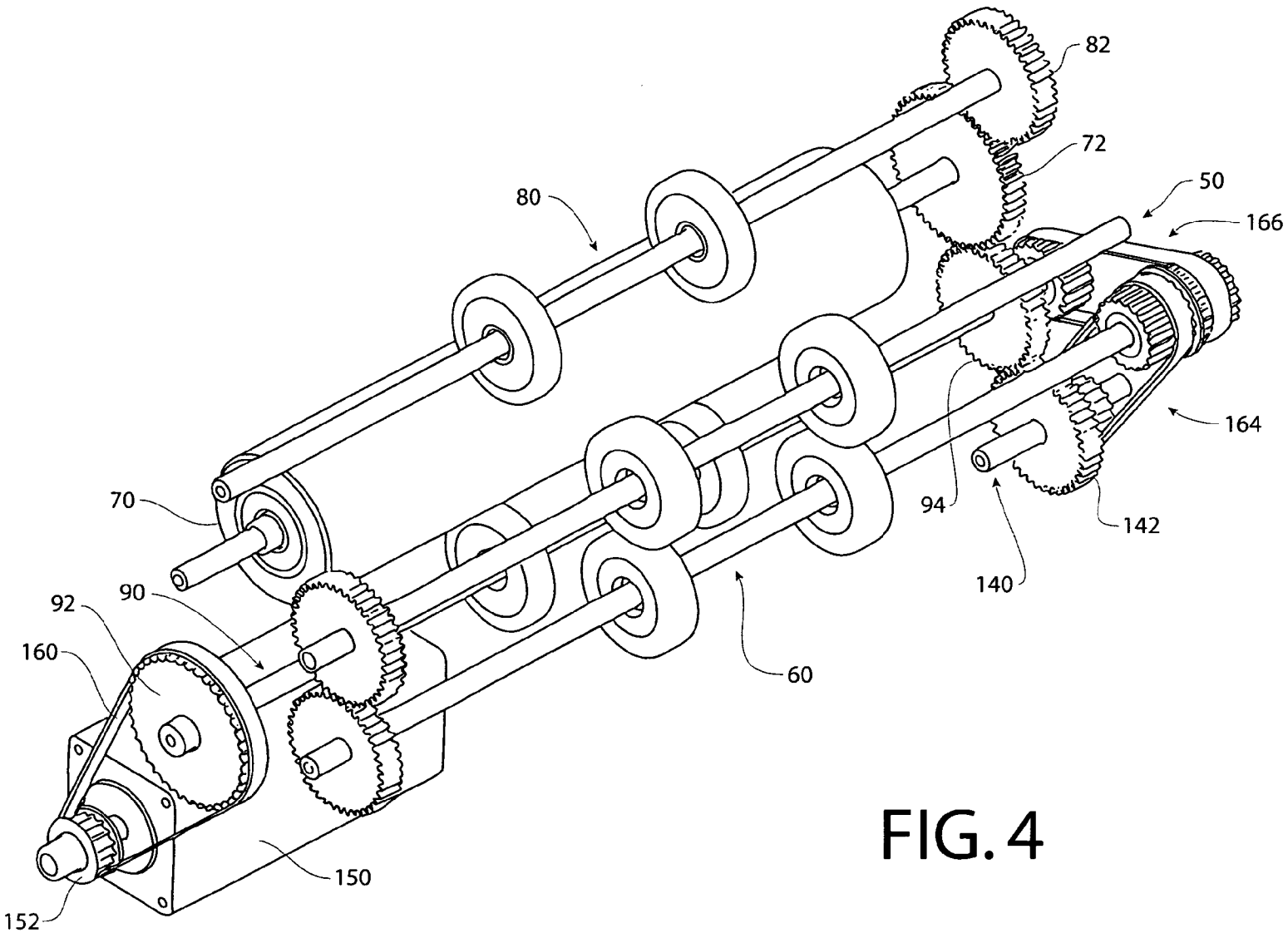
FIG. 4 illustrates the driving mechanism and the linkage between the collation control mechanism and the exit nip.

It is possible, however, to use a single driving mechanism to drive both the control mechanism 110 and the exit rollers 50 and 60. The arrangement of the various components in the control mechanism 110, the exit rollers 50, 60 and the driving mechanism is shown in FIG. 4. As shown in FIG. 4, a motor 150 is used to drive a gear 92 of the lower roller 90, via a gear 152 and a belt 160. Another gear 94 of the lower roller 90 is engaged to a gear 72 of the drum 70 for setting the drum 70 in a rotational motion. The gear 72 is also engaged with a gear 82 of the upper roller 80. Thus, a single motor 150 is able to achieve the necessary oscillatory rotation of the drum 70, the upper roller 80 and the lower roller 90. According to the present invention, the gear 94 of the lower roller 90 is further engaged with a transfer gear 142 of a transfer axis 140. Two sets of one-way clutches are used to drive the lower exit roller 60. One set of the one-way clutches 164 is engaged with the transfer axis 140 and the other set 166 is engaged with the lower roller 90.

Figure 5A:
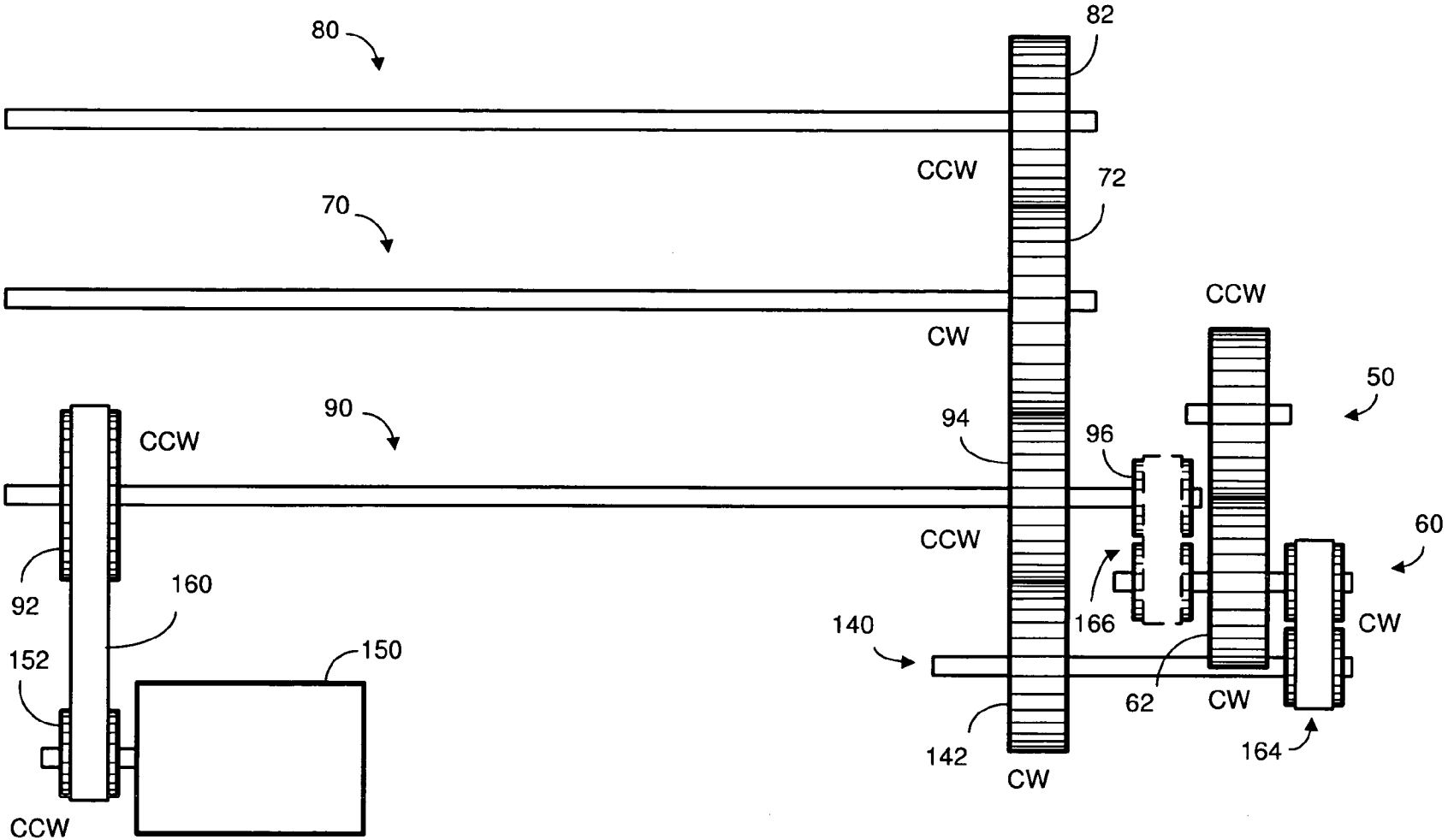
FIG. 5A illustrates the rotation directions of various components in a situation when the collation is transferred to the exit nip through the upper nip of the collation control mechanism.

FIG. 5A illustrates how the drum 70 is driven for clockwise rotation so that the upper nip 122 can be used to transfer a collation from the upper bay end 22 to the exit nip 40 (see FIG. 3A). As shown in FIG. 5A, the motor 150 rotates in the counter-clockwise direction. Through the gears 152, the belt 160 and the gear 92, the lower roller 90 also rotates in the counter-clockwise direction. As the gear 72 is engaged with both the gear 94 of the lower roller 90 and the gear 82 of the upper roller 80, the drum 70 rotates in the clockwise direction and the upper roller 80 rotates in the counter-clockwise direction. As the transfer gear 142 of the transfer axis 140 is engaged with the gear 94 of the lower roller 90, the transfer axis 140 rotates in the clockwise direction. Using a set of one-way clutches 164 to engage the lower exit roller 60 to the transfer axis 140, the lower exit roller 60 is caused to rotate in the clockwise direction and the upper exit roller 50 is caused to rotate in the counter-clockwise direction as needed.

Figure 5B:
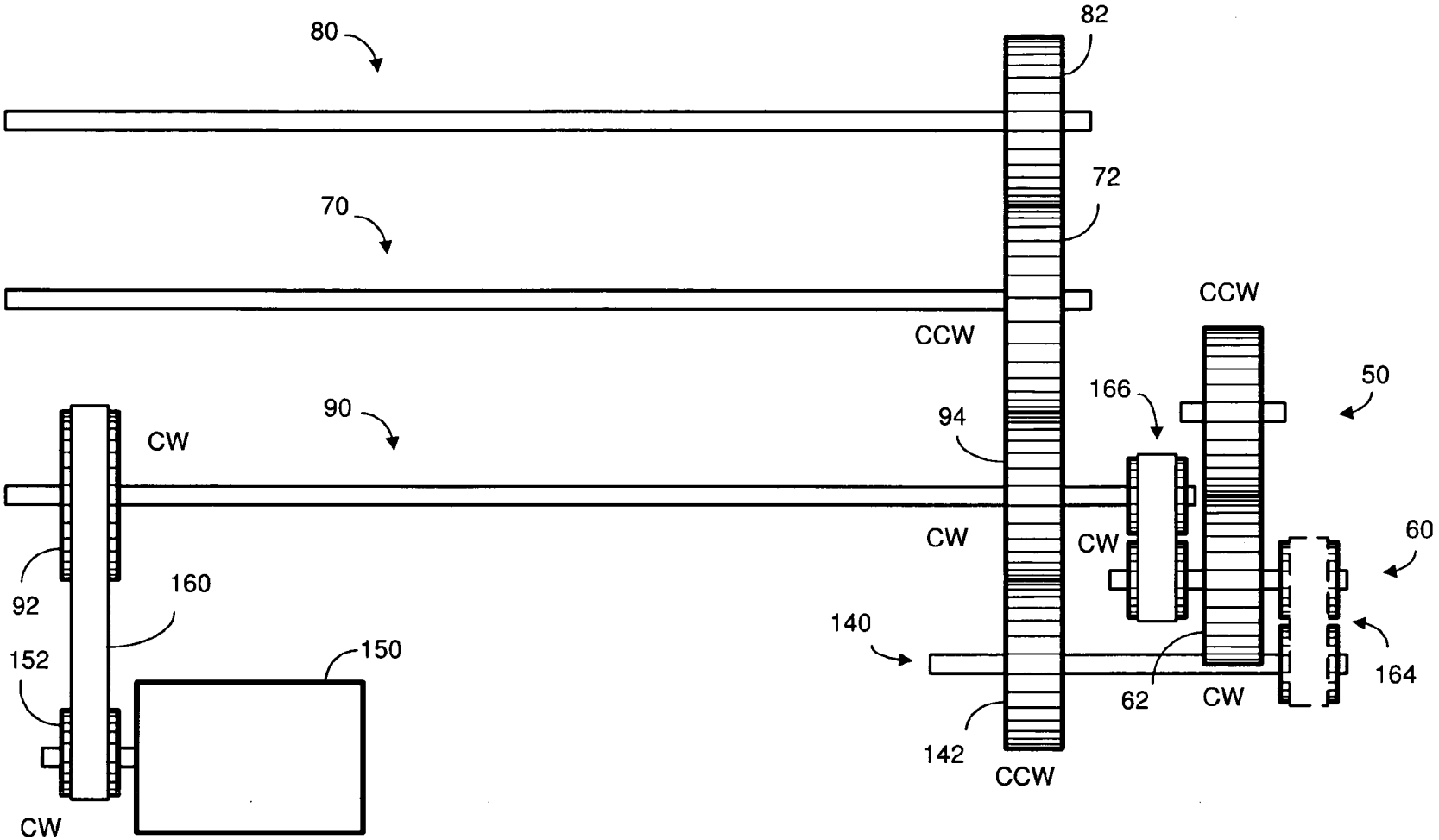
FIG. 5B illustrates the rotation directions of various components in a situation when the collation is transferred to the exit nip through the lower nip of the collation control mechanism.

FIG. 5B illustrates how the drum 70 is driven for counter-clockwise rotation so that the lower nip 132 can be used to transfer a collation from the lower bay end 32 to the exit nip 40 (see FIG. 3B). As shown in FIG. 5B, the motor 150 rotates in the clockwise direction. Through the gears 152, the belt 160 and the gear 92, the lower roller 90 also rotates in the clockwise direction. As the gear 72 is engaged with both the gear 94 of the lower roller 90 and the gear 82 of the upper roller 80, the drum 70 rotates in the counter-clockwise direction. As the transfer gear 142 of the transfer axis 140 is engaged with the gear 94 of the lower roller 90, the transfer axis 140 rotates in the counter-clockwise direction. Using another set of one-way clutches 166 to engage the lower exit roller 60 to the lower roller 90, the lower exit roller 60 is caused to rotate in the clockwise direction and the upper exit roller 50 is caused to rotate in the counter-clockwise direction as needed.

Figure 5D:
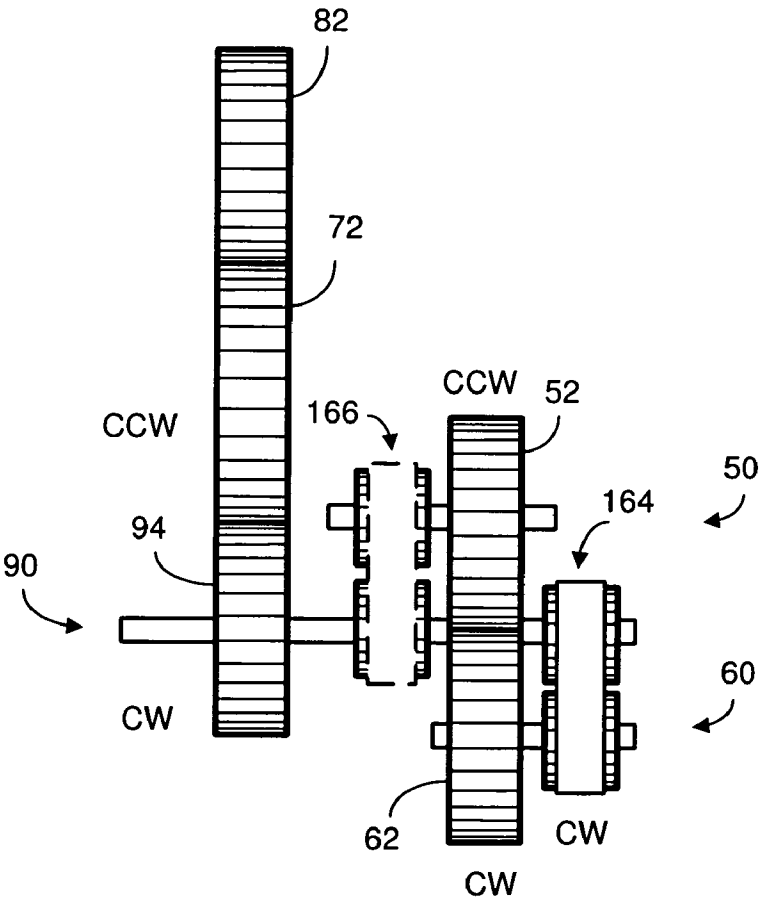
FIG. 5D illustrates a different way to engage the exit nip with the collation control mechanism.
Figure 5C:
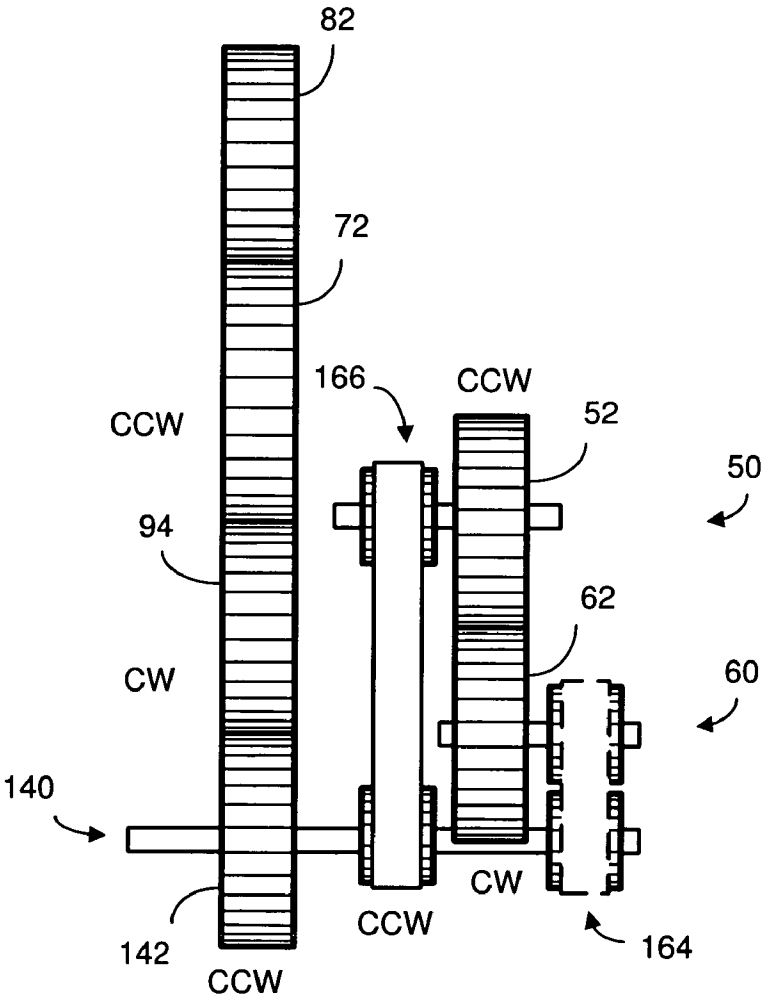
FIG. 5C illustrates another way to engage the exit nip with the collation control mechanism.

It should be noted that, when only one driving mechanism, such as a motor, is used to drive the control mechanism 110 and the exit rollers 50 and 60, it is possible to engage the exit rollers 50, 60 differently than the linkage as depicted in FIGS. 4, 5A and 5B. For example, instead of linking the lower roller 90 and the lower exit roller 60, it is possible to link the upper exit roller 50 to the transfer axis 140 with a set of one-way clutches 166, as shown in FIG. 5C, so that the upper exit roller 50 can be caused to rotate in the counter-clockwise direction when the motor rotates in the clockwise direction. Alternatively, both the upper exit roller 50 and the lower exit roller 60 are engaged with the lower roller 90 via the one-way clutches 164 and 166, as shown in FIG. 5D. The mechanical linkage as depicted in FIGS. 4, 5A and 5B is only used as an example. There are many different ways to achieve the method of controlling the collation in the merging region using a single drum rotating in an oscillatory fashion. It is also possible to use two or more motors or other driving mechanisms to separately drive the control mechanism 110 and the exit rollers 50, 60.

Figure 6:
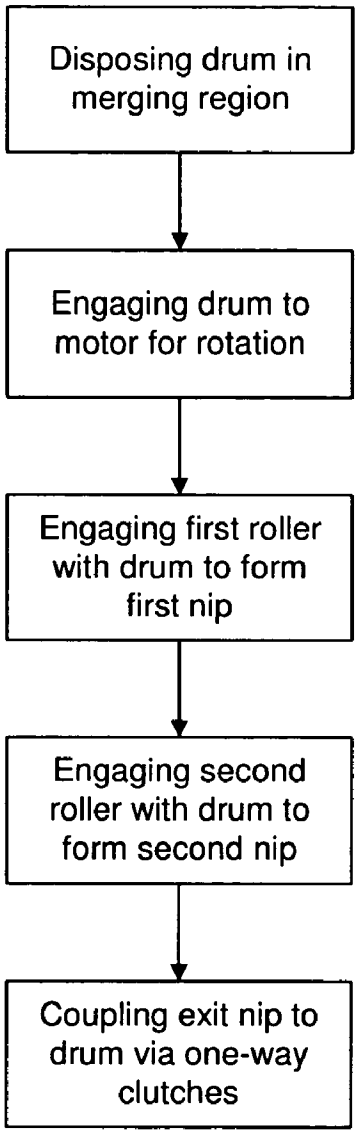
FIG. 6 is a flowchart illustrating the method for controlling a collation in the merging region, according to the present invention.

The method for controlling a collation in the merging region between a dual accumulator and an exit nip is illustrated in the flowchart of FIG. 6. The method includes the steps of installing a rotatable drum in the merging region. The drum is operatively linked to a driving mechanism, such as a motor for rotation. Two rollers are separately engaged with the drum to form an upper nip and a lower nip. When the same driving mechanism is used to drive the exit nip, a coupling mechanism that has two sets of one-way clutches is used to couple the exit nip to the drum, directly or indirectly.

Thus, although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. An apparatus, comprising:

a rotatable drum positioned between an exit nip and a dual accumulator, the rotatable drum adapted to rotate in a clockwise direction for transferring a collation from a first bay of the dual accumulator to the exit nip, or in a counter-clockwise direction for transferring a collation from a different second bay of the dual accumulator to the exit nip;

a first roller, located adjacent to the rotatable drum, for forming a first nip with the rotatable drum, wherein when the rotatable drum rotates in the clockwise direction, the first roller is caused to rotate in the counter-clockwise direction for transferring the collation from the first bay through the first nip; and a second roller, located adjacent to the rotatable drum and spaced from the first roller, for forming a second nip with the rotatable drum, wherein when the rotatable drum rotates in the counter-clockwise direction, the second roller is caused to rotate in the clockwise direction for transferring the collation from the second bay through the second nip.

2. The apparatus of claim 1, further comprising:

a driving mechanism operatively connected to the rotatable drum for causing the rotatable drum to rotate in the clockwise or counter-clockwise direction.

3. The apparatus of claim 1, wherein the first roller is fixedly attached to a first roller shaft for rotation the second roller is fixedly attached to a second roller shaft for rotation, and the rotatable drum is fixedly attached to a drum shaft for rotation; and wherein the first roller shaft comprises a first roller gear fixedly attached to the first roller shaft;

the second roller shaft comprises a second roller gear fixedly attached to the second roller shaft; and the drum shaft comprises a drum shaft gear fixedly attached to the drum shaft, the drum shaft gear separately engaged with the first roller gear and the second roller gear, said apparatus further comprising:

a driving mechanism, operatively engaged with one of the first roller shaft, the second roller shaft and the drum shaft for driving the first roller shaft, the second roller shaft and the drum shaft.

4. The apparatus of claim 3, wherein the exit nip has a first exit roller and a second exit roller, and wherein the first exit roller and the first exit roller are adapted to rotate in opposite directions, said apparatus further comprising a coupling mechanism for engaging at least one of the first and second rollers to the driving mechanism for rotation.

5. The apparatus of claim 4, wherein the driving mechanism is engaged with the second roller shaft for driving the first roller shaft, the second roller shaft and the drum shaft;

the first exit roller is adapted to rotate in the counter-clockwise direction; and the second exit roller is adapted to rotate in the clockwise direction, and wherein the coupling mechanism comprises:

a first set of one-way clutches for mechanically engaging the second exit roller to the second shaft for causing the second exit roller to rotate in the clockwise direction, and a second set of one-way clutches for mechanically engaging the second exit roller to the second shaft through a transfer axis for causing the second exit roller to rotate in the clockwise direction.

6. The apparatus of claim 4, wherein the driving mechanism is engaged with the second roller shaft for driving the first roller shaft, the second roller shaft and the drum shaft;

the first exit roller is adapted to rotate in the counter-clockwise direction; and the second exit roller is adapted to rotate in the clockwise direction, and wherein the coupling mechanism comprises:

a first set of one-way clutches for mechanically engaging the first exit roller to the second shaft for causing the first exit roller to rotate in the counter clockwise direction, and a second set of one-way clutches for mechanically engaging the second exit roller to the second shaft for causing the second exit roller to rotate in the clockwise direction.

7. The apparatus of claim 6, wherein the first exit roller and the second exit roller are engaged with the second draft through a transfer axis.

8. A sheet collator comprising:

an exit nip; and a dual accumulator, wherein the dual accumulator comprising a first bay for collating sheets received in the first bay into a collation, the first bay having a first bay end for releasing the collation to the exit nip, and a second bay, located adjacent to the first bay, for collating sheets received in the second bay into a collation, the second bay having a second bay end for releasing the collation to the exit nip; and a rotatable drum positioned between the exit nip and the dual accumulator; wherein the rotatable drum is adapted for rotating in a clockwise direction for transferring the collation from the first bay end to the exit nip, or in a counter-clockwise direction for transferring a collation from the second bay end to the exit nip.

9. The sheet collator of claim 8, further comprising:

a first roller, located adjacent to the rotatable drum, for forming a first nip with the rotatable drum, wherein when the rotatable drum rotates in the clockwise direction, the first roller is caused to rotate in the counter-clockwise direction for transferring the collation from the first bay through the first nip; and a second roller, located adjacent to the rotatable drum and spaced from the first roller, for forming a second nip with the rotatable drum, wherein when the rotatable drum rotates in the counter-clockwise direction, the second roller is caused to rotate in the clockwise direction for transferring the collation from the second bay through the second nip.

* * * * *